US010681486B2

(12) United States Patent
Wang et al.

(10) Patent No.: US 10,681,486 B2
(45) Date of Patent: Jun. 9, 2020

(54) METHOD, ELECTRONIC DEVICE AND RECORDING MEDIUM FOR OBTAINING HI-RES AUDIO TRANSFER INFORMATION

(71) Applicant: HTC Corporation, Taoyuan (TW)

(72) Inventors: Tien-Ming Wang, Taoyuan (TW); Li-Yen Lin, Taoyuan (TW); Chun-Min Liao, Taoyuan (TW); Chi-Tang Ho, Taoyuan (TW); Yan-Min Kuo, Taoyuan (TW); Tsung-Yu Tsai, Taoyuan (TW)

(73) Assignee: HTC Corporation, Taoyuan (TW)

( * ) Notice: Subject to any disclaimer, the term of this patent is extended or adjusted under 35 U.S.C. 154(b) by 0 days.

(21) Appl. No.: 16/163,587

(22) Filed: Oct. 18, 2018

(65) Prior Publication Data

US 2019/0116447 A1 Apr. 18, 2019

Related U.S. Application Data

(60) Provisional application No. 62/574,151, filed on Oct. 18, 2017.

(51) Int. Cl.
*H04S 7/00* (2006.01)
*H04S 3/00* (2006.01)

(52) U.S. Cl.
CPC ..... *H04S 7/303* (2013.01); *H04S 7/307* (2013.01); *H04S 3/008* (2013.01); *H04S 2400/11* (2013.01); *H04S 2400/15* (2013.01); *H04S 2420/01* (2013.01)

(58) Field of Classification Search
CPC ..... H04S 2400/11; H04S 2400/15; H04S 2420/01; H04S 3/008; H04S 7/303; H04S 7/307
USPC ..... 381/22, 23, 61, 63, 303; 704/E21.11
See application file for complete search history.

(56) References Cited

U.S. PATENT DOCUMENTS

| | | | | |
|---|---|---|---|---|
| 10,225,643 | B1 * | 3/2019 | Cilingir | H04R 1/222 |
| 2003/0044024 | A1 * | 3/2003 | Aarts | G10L 21/038 381/61 |
| 2004/0008615 | A1 * | 1/2004 | Oh | H04S 1/007 370/203 |
| 2006/0192706 | A1 * | 8/2006 | Fujiyama | G10L 21/038 341/155 |
| 2007/0109977 | A1 * | 5/2007 | Mittal | G10L 21/038 370/260 |

(Continued)

*Primary Examiner* — Vivian C Chin
*Assistant Examiner* — Friedrich Fahnert
(74) *Attorney, Agent, or Firm* — JCIPRNET

(57) ABSTRACT

A method for obtaining Hi-Res audio transfer information is provided. The method is applicable to the electronic device having a processor. In the method, a first audio signal is captured and converted from the time domain into in the frequency domain to generate a first signal spectrum. Then, a regression analysis is performed on an energy distribution of the first signal spectrum to predict an extended energy distribution according to the first signal spectrum, and head-related parameters are used to compensate for the extended energy distribution to generate an extended signal spectrum. Finally, the first signal spectrum and the extended signal spectrum are combined into a second signal spectrum which is converted from the frequency domain into the time domain to generate a second audio signal including Hi-Res audio transfer information.

20 Claims, 5 Drawing Sheets

(56) References Cited

U.S. PATENT DOCUMENTS

| | | | | |
|---|---|---|---|---|
| 2008/0004866 | A1* | 1/2008 | Virolainen | G10L 19/008 704/205 |
| 2008/0126904 | A1* | 5/2008 | Sung | G10L 19/005 714/746 |
| 2017/0188174 | A1* | 6/2017 | Lee | H04S 7/303 |
| 2017/0221498 | A1* | 8/2017 | Gao | G10L 19/0204 |
| 2018/0018983 | A1* | 1/2018 | Kaniewska | G10L 19/087 |
| 2018/0304659 | A1* | 10/2018 | Kaniewska | G10L 21/038 |
| 2019/0098426 | A1* | 3/2019 | Makivirta | H04R 3/04 |
| 2019/0098427 | A1* | 3/2019 | Gomez-Bolanos | H04S 7/307 |
| 2019/0130927 | A1* | 5/2019 | Gomez-Bolanos | H04R 5/033 |

* cited by examiner

METHOD, ELECTRONIC DEVICE AND RECORDING MEDIUM FOR OBTAINING HI-RES AUDIO TRANSFER INFORMATION

CROSS-REFERENCE TO RELATED APPLICATION

This application claims the priority benefit of U.S. provisional application Ser. No. 62/574,151, filed on Oct. 18, 2017. The entirety of the above-mentioned patent application is hereby incorporated by reference herein and made a part of this specification.

BACKGROUND OF THE DISCLOSURE

Field of the Disclosure

The disclosure relates to an audio transfer technology, and more particularly to a method for obtaining Hi-Res (High-Resolution) audio transfer information, an electronic device and a recording medium having the function of obtaining Hi-Res audio transfer information.

Description of Related Art

With the rapid development of the digital media and entertainment industry, the demand for stereo sound effect is increasing, and consumers' requirement for the resolution of sound is increasing as well. Generally speaking, the stereo sound effect is used on various software and hardware platforms so that the sound effects of multimedia entertainment such as games, movies, music, etc. are created to sound more real. For example, stereo sound effect may be applied to head-mounted display devices for virtual reality (VR), Augmented Reality (AR) or Mixed Reality (MR), or headphones, audio equipment, thereby bringing a better user experience.

Currently, the method of converting a general sound effect into a stereo sound effect is typically performed by measuring a Head-Related Impulse Response (HRIR) corresponding to a time domain or a Head-Related Transfer Function (HRTF) corresponding to a frequency domain and converted from the HRIR so as to convert a non-directional audio signal into a stereo sound effect.

However, today's stereo sound effect technology is limited by measuring instruments and environments. The HRIR required for stereo sound effect synthesis has a sample frequency that supports only 44.1 kHz and up to 48 kHz in few cases. The above limitation results in that even if the input audio signal has a high frequency band, it is impossible to maintain a high frequency band when the HRTF is converted into the stereo audio signal, and the output resolution is limited. If it is desired to directly sample HRIR with high frequency band, such as a sample frequency of 96 kHz or higher, it is necessary to use a speaker that emits high-frequency sound in an anechoic chamber and make measurement with a device that can receive high-frequency signal. The above-mentioned measuring method requires high costs, and typically can only be used to measure the HRIR of a specific dummy head.

SUMMARY OF THE DISCLOSURE

In view of the above, the disclosure provides a method, an electronic device, and a recording medium for obtaining Hi-Res (High-Resolution) audio transfer information, which is capable of converting an audio signal lacking high-frequency impulse response information into a Hi-Res stereo audio signal with high-frequency impulse response information and directivity.

The disclosure provides a method for obtaining Hi-Res (high resolution) audio transfer information, which is adapted for an electronic device having a processor, and the method includes the following steps. A first audio signal is captured. The first audio signal is converted from a time domain into a frequency domain to generate a first signal spectrum. A regression analysis is performed on an energy distribution of the first signal spectrum to predict an extended energy distribution in the frequency domain according to the first signal spectrum. The head-related parameter is used to compensate for the extended energy distribution to generate an extended signal spectrum. The first signal spectrum is combined with the extended signal spectrum to generate a second signal spectrum which is converted from the frequency domain into the time domain to generate a second audio signal having Hi-Res audio transfer information.

In an embodiment of the disclosure, the first audio signal records head-related impulse response information.

In an embodiment of the disclosure, the step of combining the first signal spectrum and the extended signal spectrum to generate the second signal spectrum includes: adjusting an energy value of a plurality of frequency bands in the first signal spectrum and the extended signal spectrum by using equal loudness contours of the psychoacoustic model to generate a second signal spectrum.

In an embodiment of the disclosure, the first audio signal is obtained by using a sound capturing device disposed on the ear to capture a related impulse response of sound source.

In an embodiment of the disclosure, the step of performing regression analysis on the energy distribution of the first signal spectrum to predict the extended energy distribution in the frequency domain according to the first signal spectrum includes: dividing the first signal spectrum into multiple frequency bands, and using the regression analysis to predict the extended energy distribution of the first signal spectrum in the frequency domain above the highest frequency according to the energy relationship between the frequency bands.

In an embodiment of the disclosure, the step of using the head-related parameter to compensate for the extended energy distribution to generate the extended signal spectrum includes: reconstructing the extended signal spectrum that is subjected to head-related compensation and includes information of the extended energy distribution in the frequency domain.

In an embodiment of the disclosure, the step of using the head-related parameter to compensate for the extended energy distribution to generate the extended signal spectrum includes: determining the weight grid according to the head-related parameter. The weight grid is divided into a plurality of weight grid areas corresponding to the plurality of directions of the electronic device, and the energy weights of the sound sources in different weight grid areas are recorded. The energy weight of the weight grid area corresponding to the direction of the first audio signal is selected to compensate for the extended energy distribution in the frequency domain to reconstruct the extended signal spectrum that is subjected to head-related compensation and includes the information of the extended energy distribution.

In an embodiment of the disclosure, the head-related parameter includes the shape, size, structure and/or density of head, ears, nasal cavity, mouth, torso, and the weight grid is adjusted according to the head-related parameter.

In an embodiment of the disclosure, the Hi-Res stereo audio conversion method further includes: receiving a third audio signal of Hi-Res audio data, and converting a third audio signal into a third signal spectrum in the frequency domain. A fast convolution operation is performed on the third signal spectrum and the second signal spectrum to obtain a fourth signal spectrum. The fourth signal spectrum is converted into a fourth audio signal of the Hi-Res audio that is subjected to head-related compensation in a time domain.

The electronic device of the disclosure includes a data capturing device, a storage device, and a processor. The data capturing device captures an audio signal. The storage device stores one or more instructions. The processor is coupled to the data capturing device and the storage device, and configured to execute the instructions to: control the data capturing device to capture a first audio signal. The first audio signal is converted from a time domain into a frequency domain to generate a first signal spectrum. Regression analysis is performed on an energy distribution of the first signal spectrum to predict an extended energy distribution in the frequency domain according to the first signal spectrum. The head-related parameter is used to compensate for the extended energy distribution to generate an extended signal spectrum. The first signal spectrum is combined with the extended signal spectrum to generate a second signal spectrum, which is converted from the frequency domain into the time domain to generate a second audio signal having Hi-Res audio transfer information.

In an embodiment of the disclosure, the first audio signal records a head-related impulse response information.

In an embodiment of the disclosure, in the operation of combining the first signal spectrum and the extended signal spectrum to generate the second signal spectrum, the processor is configured to adjust an energy value of a plurality of frequency bands in the first signal spectrum and the extended signal spectrum by using equal loudness contours of the psychoacoustic model to generate a second signal spectrum.

In an embodiment of the disclosure, the electronic device further includes a sound capturing device. The sound capturing device is disposed on the ear and coupled to the data capturing device, wherein the first audio signal is obtained by using the sound capturing device to capture a related impulse response of sound source.

In an embodiment of the disclosure, in the operation of performing regression analysis on the energy distribution of the first signal spectrum to predict the extended energy distribution in the frequency domain according to the first signal spectrum, the processor is configured to divide the first signal spectrum into multiple frequency bands, and perform the regression analysis to predict the extended energy distribution of the first signal spectrum in the frequency domain above the highest frequency according to the energy relationship between the frequency bands.

In an embodiment of the disclosure, in the operation of using the head-related parameter to compensate for the extended energy distribution to generate the extended signal spectrum, the processor is configured to reconstruct the extended signal spectrum that is subjected to head-related compensation and includes information of the extended energy distribution in the frequency domain.

In an embodiment of the disclosure, in the operation of using the head-related parameter to compensate for the extended energy distribution to generate the extended signal spectrum, the processor is configured to determine the weight grid according to the head-related parameter. The weight grid is divided into a plurality of weight grid areas corresponding to the plurality of directions of the electronic device, and the energy weights of the sound sources in different weight grid areas are recorded. The energy weight of the weight grid area corresponding to the direction of the first audio signal is selected to compensate for the extended energy distribution to reconstruct the extended signal spectrum that is subjected to head-related compensation and includes the information of the extended energy distribution in the frequency domain.

In an embodiment of the disclosure, the processor is configured to adjust the weight grid according to the head-related parameter.

In an embodiment of the disclosure, the head-related parameter includes the shape, size, structure and/or density of head, ears, nasal cavity, mouth and torso.

In an embodiment of the disclosure, the processor is further configured to receive a third audio signal of Hi-Res audio data, and converts a third audio signal into a third signal spectrum in the frequency domain. A fast convolution operation is performed on the third signal spectrum and the second signal spectrum to obtain a fourth signal spectrum. The fourth signal spectrum is converted into a fourth audio signal of the Hi-Res audio that is subjected to head-related compensation in a time domain.

The disclosure further provides a computer readable recording medium, which records a program which is loaded via an electronic device to perform the following steps. A first audio signal is captured. The first audio signal is converted from a time domain into to a frequency to generate a first signal spectrum. Regression analysis is performed on an energy distribution of the first signal spectrum to predict an extended energy distribution in the frequency domain according to the first signal spectrum. A head-related parameter is used to compensate for the extended energy distribution to generate an extended signal spectrum. The first signal spectrum is combined with the extended signal spectrum to generate a second signal spectrum which is converted from the frequency domain into the time domain to generate a second audio signal having Hi-Res audio transfer information.

In order to make the aforementioned features and advantages of the disclosure more comprehensible, embodiments accompanying figures are described in detail below.

BRIEF DESCRIPTION OF THE DRAWINGS

The accompanying drawings are included to provide a further understanding of the disclosure, and are incorporated in and constitute a part of this specification. The drawings illustrate exemplary embodiments of the disclosure and, together with the description, serve to explain the principles of the disclosure.

DESCRIPTION OF EMBODIMENTS

Figure 1:
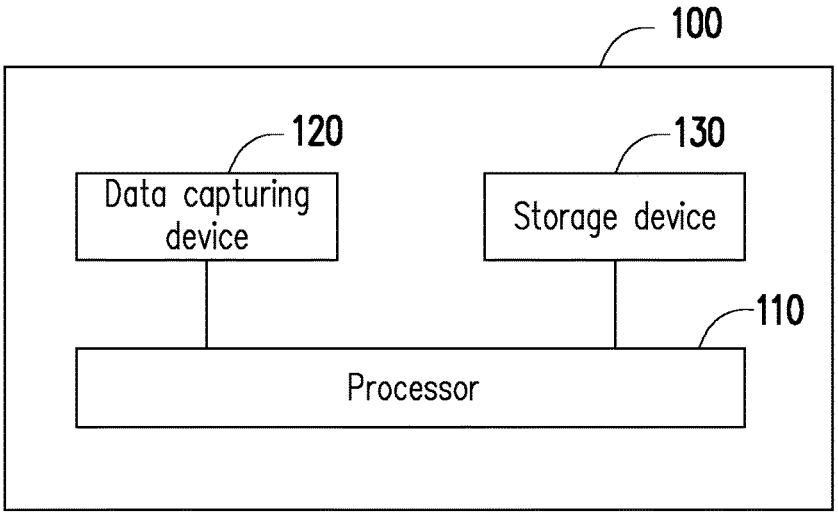
FIG. 1 is a block diagram of an electronic device according to an embodiment of the disclosure.

Reference will now be made in detail to the present embodiments of the disclosure, examples of which are illustrated in the accompanying drawings. Wherever possible, the same reference numbers are used in the drawings and the description to refer to the same or like parts.

It will be understood that, in the description herein and throughout the claims that follow, when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Moreover, "electrically connect" or "connect" can further refer to the interoperation or interaction between two or more elements.

It will be understood that, in the description herein and throughout the claims that follow, although the terms "first," "second," etc. may be used to describe various elements, these elements should not be limited by these terms. These terms are only used to distinguish one element from another. For example, a first element could be termed a second element, and, similarly, a second element could be termed a first element, without departing from the scope of the embodiments.

It will be understood that, in the description herein and throughout the claims that follow, the terms "comprise" or "comprising," "include" or "including," "have" or "having," "contain" or "containing" and the like used herein are to be understood to be open-ended, i.e., to mean including but not limited to.

It will be understood that, in the description herein and throughout the claims that follow, the phrase "and/or" includes any and all combinations of one or more of the associated listed items.

It will be understood that, in the description herein and throughout the claims that follow, unless otherwise defined, all terms (including technical and scientific terms) have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any element in a claim that does not explicitly state "means for" performing a specified function, or "step for" performing a specific function, is not to be interpreted as a "means" or "step" clause as specified in 35 U.S.C. § 112(f). In particular, the use of "step of" in the claims herein is not intended to invoke the provisions of 35 U.S.C. § 112(f).

The disclosure converts the original low-resolution head-related transfer function (HRTF) into a Hi-Res head-related transfer function (Hi-Res HRTF) by using a regression predicting model and a human ear hearing statistical model under limited conditions. When processing audio, the input audio data is converted to the frequency domain, and a fast convolution is performed on the converted audio data in the frequency domain by using the Hi-Res HRTF, and finally the operation result is converted back to the time domain to obtain a Hi-Res output result. In this manner, the amount of calculation may be greatly reduced, thereby achieving the purpose of calculating 3D sound effect processing in real-time.

FIG. 1 is a block diagram of an electronic device according to an embodiment of the disclosure. Referring to FIG. 1, an electronic device 100 includes a processor 110, a data capturing device 120, and a storage device 130. The processor 110 is coupled to the data capturing device 120 and the storage device 130, and is capable of accessing and executing the instructions recorded in the storage device 130 to realize the method for obtaining Hi-Res audio transfer information in the embodiment of the disclosure. The electronic device 100 may be any device that needs to generate a stereo sound effect, such as a VR, AR or MR head-mounted device, or a headphone, an audio, etc., and the disclosure is not limited thereto.

In various embodiments, the processor 110 is, for example, a central processing unit (CPU), or other programmable general-purpose or specific-purpose microprocessor, a digital signal processor (DSP), a programmable controller, an Application Specific Integrated Circuits (ASIC), a programmable logic device (PLD), or the like, or a combination thereof, the disclosure provides no limitation thereto.

In the embodiment, the data capturing device 120 captures audio signals. The audio signal is, for example, an audio signal recorded with head-related impulse response information (for example, HRIR). The audio signal is, for example, a stereo audio signal measured by a measuring machine with a lower sampling frequency such as 44.1 kHz or 48 kHz, as being limited by the measuring machine and the environment, the measured stereo audio signal lacks a high-frequency impulse response information. Specifically, the data capturing device 120 may be any device that receives the audio signal measured by the measuring machine in a wired manner, such as a Universal Serial Bus (USB), a 3.5 mm sound source jack, or any receiver that supports wirelessly receiving audio signals, such as a receiver that supports one of the following communication technologies such as Wireless Fidelity (Wi-Fi) systems, Worldwide Interoperability for Microwave Access (Wi-MAX) systems, third-generation (3G) wireless communication technology, fourth-generation (4G) wireless communication technology, fifth-generation (5G) wireless communication technology, Long Term Evolution (LTE), infrared transmission, Bluetooth (BT) communication technology or a combination of the above, the disclosure is not limited thereto.

The storage device 130 is, for example, any type of fixed or removable random access memory (RAM), a read-only memory (ROM), a flash memory, a hard disk or other similar device or a combination of these devices to store one or more instructions executable by the processor 110, and the instructions may be loaded into the processor 110.

Figure 2:
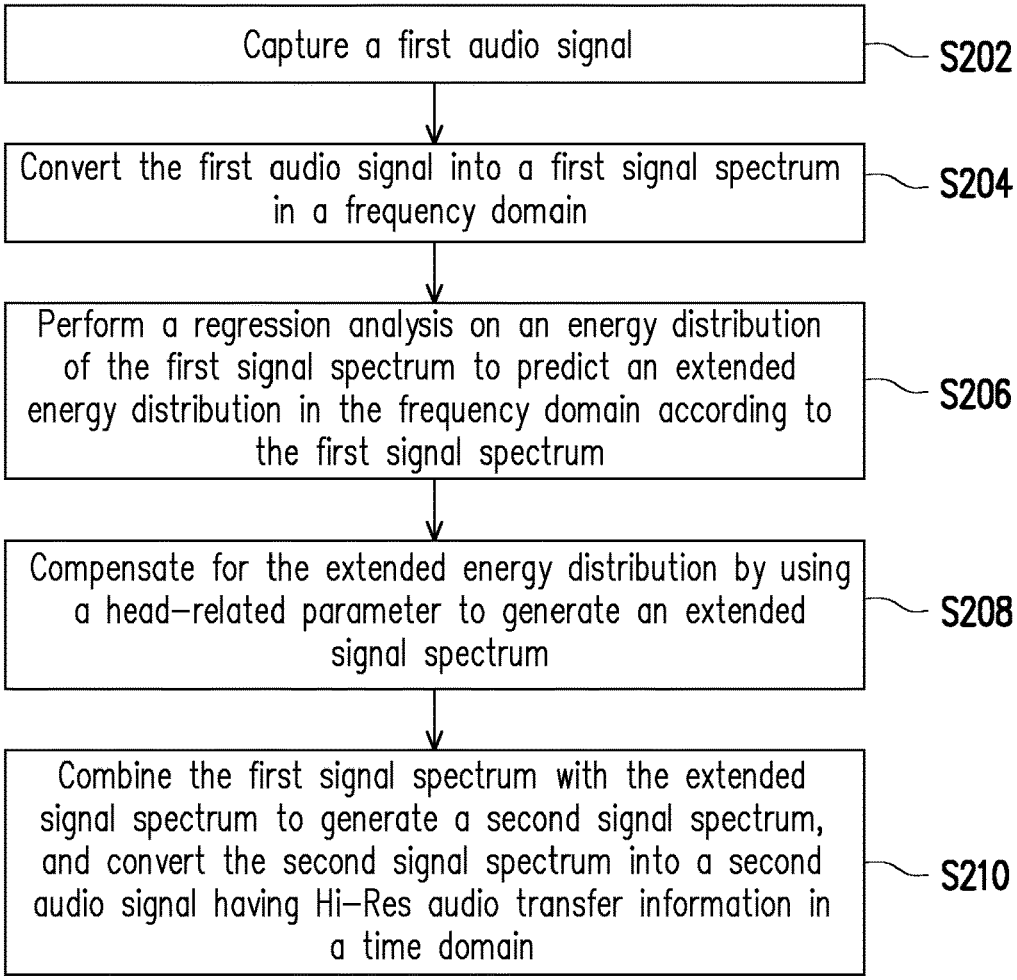
FIG. 2 is a flow chart of a method for obtaining Hi-Res audio transfer information according to an embodiment of the disclosure.

FIG. 2 is a flow chart of a method for obtaining Hi-Res audio transfer information according to an embodiment of the disclosure. Referring to FIG. 1 and FIG. 2, the method of this embodiment is adapted for the above-described electronic device 100. The following is a detailed description of the method for obtaining Hi-Res audio transfer information in the embodiment of the disclosure with reference to various devices and components of the electronic device 100.

First, the data capturing device 120 is controlled by the processor 110 to capture a first audio signal (step S202). The first audio signal records a head-related impulse response information. The head-related impulse response information includes a direction R (θ, φ) of the first audio signal, θ is a horizontal angle of the first audio signal, and φ is a vertical angle of the first audio signal.

Next, the processor 110 converts the first audio signal into a first signal spectrum in a frequency domain (step S204). The processor 110 performs a Fast Fourier Transform (FFT) on the first audio signal to convert the first audio signal from the time domain into the frequency domain to generate a first signal spectrum.

Thereafter, the processor 110 performs a regression analysis on an energy distribution of the first signal spectrum to predict an extended energy distribution in the frequency domain according to the first signal spectrum (step S206). Next, the processor 110 compensates for the extended energy distribution by using a head-related parameter to generate an extended signal spectrum (step S208). In detail, the processor 110 divides the first signal spectrum into a plurality of frequency bands, and uses regression analysis to predict the extended energy distribution of the first signal spectrum in the frequency domain above the highest frequency according to the energy relationship among the frequency bands.

Figure 3A:
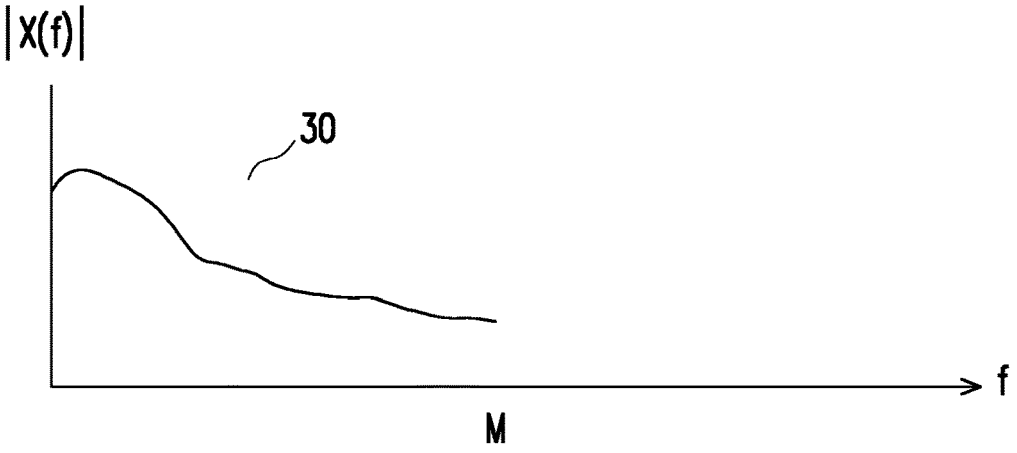
FIG. 3A illustrates an example of predicting extended energy distribution according to an embodiment of the disclosure.
Figure 3B:
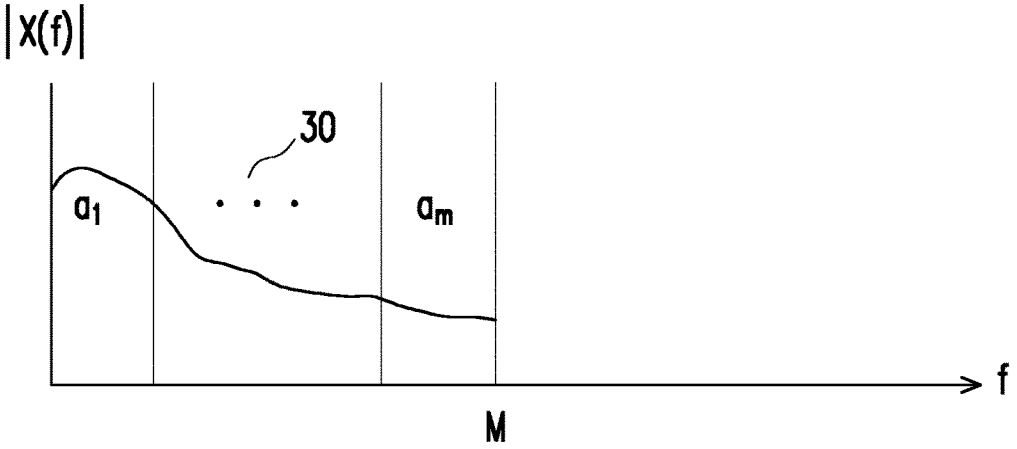
FIG. 3B illustrates an example of predicting extended energy distribution according to an embodiment of the disclosure.
Figure 3C:
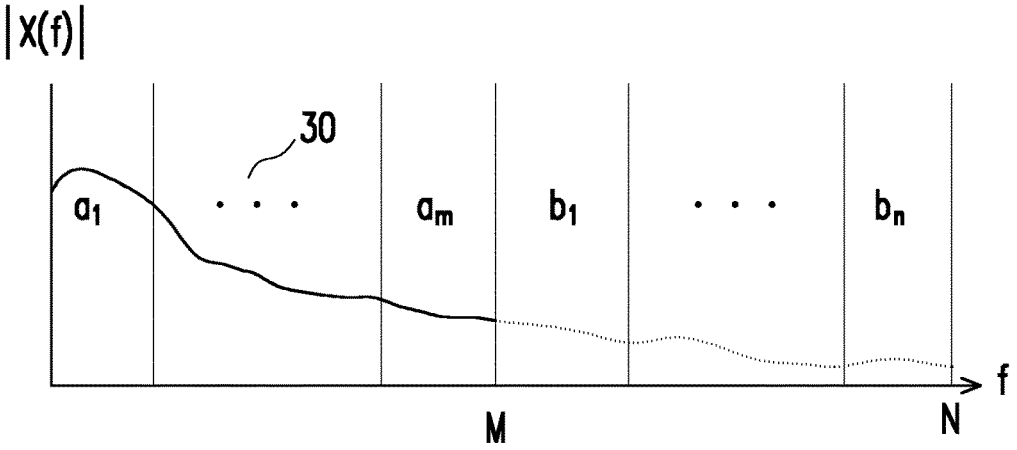
FIG. 3C illustrates an example of predicting extended energy distribution according to an embodiment of the disclosure.

For example, FIG. 3A, FIG. 3B and FIG. 3C illustrate examples of predicting extended energy distribution according to an embodiment of the disclosure. Referring to FIG. 3A, the processor 110 captures the first audio signal and converts the same into the first signal spectrum in the frequency domain. FIG. 3A illustrate an energy distribution 30 of the first signal spectrum, wherein the highest frequency of the energy distribution 30 of the first signal spectrum is M. Further referring to FIG. 3B, the processor 110 divides the energy distribution 30 of the first signal spectrum into a total of m frequency bands. On this occasion, the obtained energy of the frequency bands 1~m is $a_1$~$a_m$ respectively. Thereafter, the processor 110 derives the regression equation of the energy $a_1$~$a_m$ of the frequency bands of the first signal spectrum by, for example, using a linear regression model in equation (1):

$$y=\beta_0+\beta_1 x \tag{1}$$

Specifically, x is the frequency band 1~m, y is the energy $a_1$~$a_m$ of various frequency bands of the first signal spectrum, the loss function of $\beta_0$ and $\beta_1$ may be calculated through the linear regression model as shown in equation (2):

$$\mathrm{Loss}(\hat{\beta}_0,\hat{\beta}_1)=\Sigma_{i=1}^{n}(y_i-(\hat{\beta}_0+\hat{\beta}_1 x_i))^2 \tag{2}$$

$\beta_0$ and $\beta_1$ may be obtained through equation (2) with the least square. Referring to FIG. 3C, when $\beta_0$ and $\beta_1$ are obtained, in the embodiment, assuming that the target is to extend the energy distribution 30 of the first signal frequency spectrum to a frequency domain above the highest frequency M, and extended the energy distribution 30 of the first signal frequency spectrum to the highest frequency N. The processor 110 divides the frequency M to the frequency N into n frequency bands. On this occasion, frequency bands 1~n between the frequency M and the frequency N may be obtained. Thereafter, the obtained $\beta_0$ and $\beta_1$ are substituted into the linear regression model of the equation (1) for calculation, wherein x is frequency bands 1~n, and y is the extended energy distribution $b_1$~$b_n$. After calculating by using the regression analysis, the extended energy distribution $b_1$~$b_n$ of the first signal frequency spectrum in the frequency domain above the highest frequency M of the first signal frequency spectrum may be predicted.

In this embodiment, after predicting the extended energy distribution $b_1$~$b_n$ of the first signal spectrum in the frequency domain, the processor 110 then corrects and compensates for the extended energy distribution $b_1$~$b_n$ by using the head-related parameters. In particular, audio sources from different directions may have different interaural time differences (ITD) and interaural level difference (ILD) when entering the left and right ears due to the difference in direction of the sound source relative to the listener and the structure of each person's head and ear pinna. Based on these differences, the listener can perceive the directionality of the sound source.

In detail, when compensating for the head-related parameters, the processor 110 determines a weight grid according to, for example, the head-related parameters. The weight grid is, for example, a spherical grid, and is divided into a plurality of weight grid areas corresponding to the plurality of directions of the electronic device 100, and records the energy weight for adjusting various frequency band energy distributions when the sound source is in different weight grid areas. After the energy distribution is adjusted according to the energy weight corresponding to the weight grid area of the direction where the sound source is located, the listener's ears can perceive that the sound source is from said direction.

Figure 4:
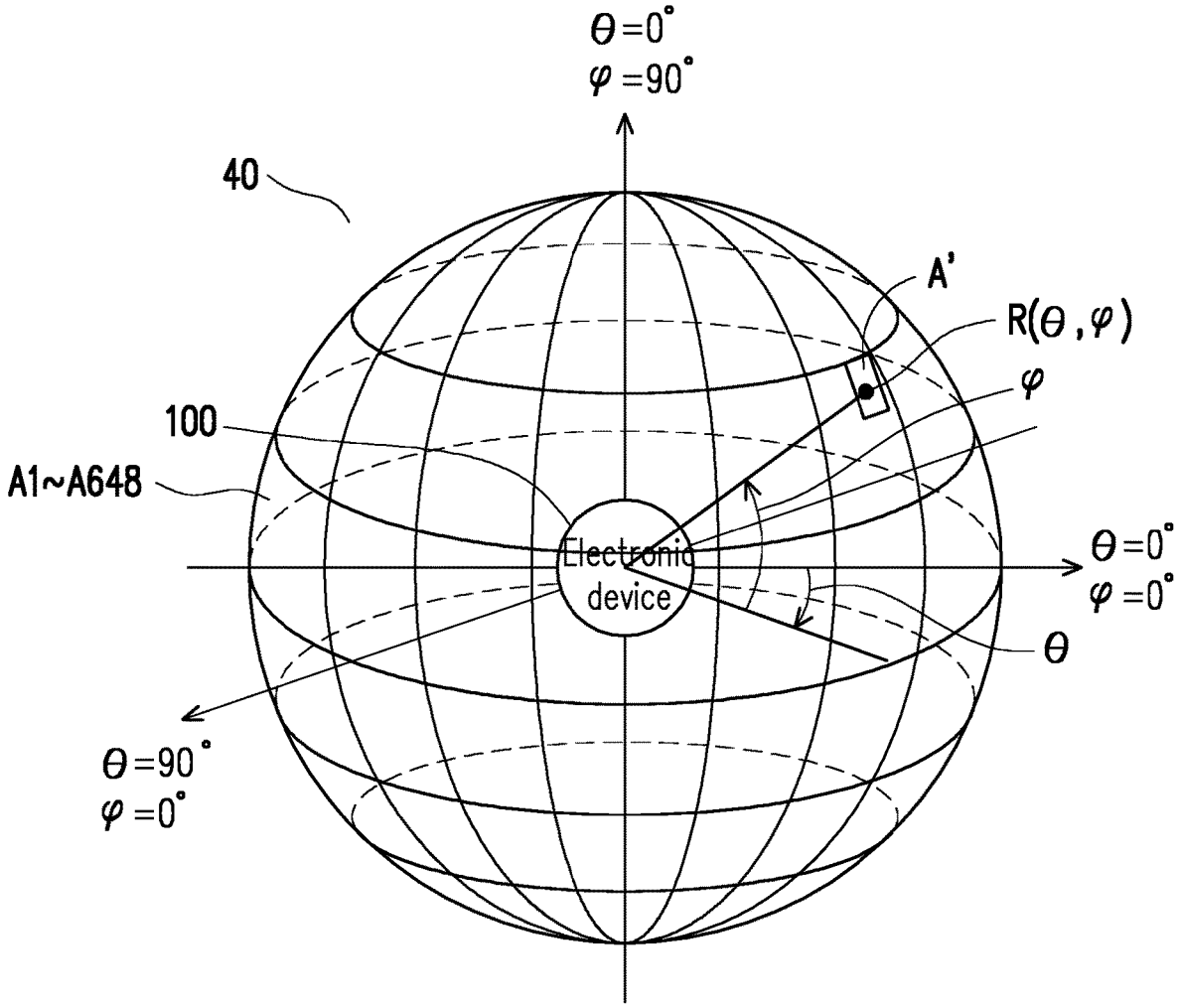
FIG. 4 illustrates an example of a weight grid according to an embodiment of the disclosure.

FIG. 4 illustrates an example of a weight grid according to an embodiment of the disclosure. Taking the weight grid 40 in FIG. 4 as an example, the weight grid 40 divides a weight grid area every 10 degrees according to the horizontal angle θ and the vertical angle φ, dividing into a total of 648 weight grid areas A1 to A648. The angle by which the weight grid is divided may also be 5 degrees or other angles, and the setting of 10 degrees herein only serves for illustrative purpose. Herein, the sound source has different energy weights in the weight grid areas A1 to A648.

In an embodiment, the weight grid 40 causes that the sound source has different energy weights in different weight grid areas A1~A648 according to different head-related parameters of different people. Therefore, the weight grid 40 is adjusted according to the head-related parameters. In an embodiment, the head-related parameters include the shape, size, structure, and/or density of the head, ears, nasal cavity, mouth and torso. In other words, the weight grids corresponding to various head-related parameters, the weight grid areas corresponding to various weight grids, and the energy weights corresponding to various weight grid areas may be pre-recorded and stored into the storage device 130.

Taking the weight grid 40 in FIG. 4 as an example, the processor 110 selects, according to the direction R(θ, φ) of the first audio signal, a weight grid area A' corresponding to the direction R(θ, φ) from the weight grid regions A1 to A648, and compensates for the extended energy distribution according to the energy weight corresponding to the weight grid area A', thereby reconstructing the extended signal spectrum that includes information of the extended energy distribution and is subjected to head-related compensation in the frequency domain above the highest frequency M of the first signal spectrum. The compensation of the energy distribution may be expressed by the following equation (3):

$$\tilde{b}_k^{\theta,\varphi}=b_k^{\theta,\varphi}\times\mathrm{Grid}(\theta,\varphi) \tag{3}$$

Specifically, θ is the horizontal angle of the first audio signal, φ is the vertical angle of the first audio signal, Grid is the weight grid, and Grid(θ, φ) represents the energy weight corresponding to the weight grid area A' in the direction R(θ, φ), k is 1~n (n is the number of frequency bands divided in the extended frequency domain), $b_k^{\theta,\varphi}$ is the energy distribution before compensating for the extended frequency domain, and $\tilde{b}_k^{\theta,\varphi}$ is the energy distribution after compensating for the extended frequency domain. That is, the processor 110 respectively multiplies the energy weight corresponding to the weight grid area A' by the extended energy distribution $b_1$~$b_n$ in the frequency domain to make compensation. After compensating for the extended energy distribution $b_1$~$b_n$ to generate the compensated extended energy distribution $b_1'$~$b_n'$, the processor 110 generates the extended signal spectrum in the frequency domain above the highest frequency M of the first signal spectrum. Specifically, the processor 110 reconstructs the extended signal spectrum that includes the information of the extended energy distribution and is subjected to head-related compensation in the frequency domain above the highest frequency M of the first signal spectrum.

After generating the extended signal spectrum, the processor 110 combines the first signal spectrum with the extended signal spectrum to generate a second signal spectrum, and converts the second signal spectrum into a second audio signal having Hi-Res audio transfer information in the time domain (step S210). The processor 110, for example, uses equal loudness contours of a psychoacoustic model to adjust the energy values of the plurality of frequency bands in the first signal spectrum and the extended signal spectrum to generate the second signal spectrum, and then performs Inverse Fast Fourier Transform (IFFT) on the second signal spectrum to convert the second signal spectrum into a second audio signal having Hi-Res audio transfer information in the time domain.

Figure 5:
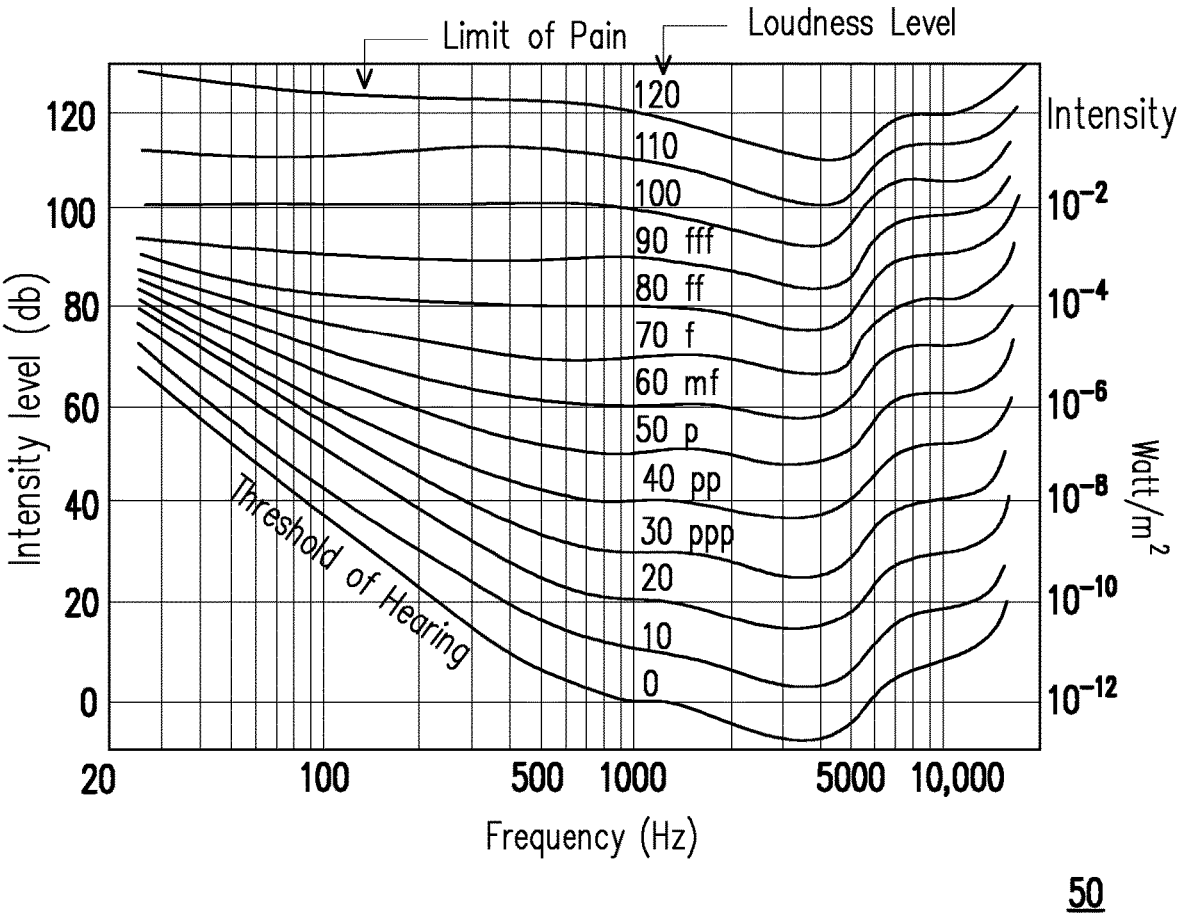
FIG. 5 illustrates an example of equal loudness contours according to an embodiment of the disclosure.

FIG. 5 illustrates an example of equal loudness contours according to an embodiment of the disclosure. Referring to FIG. 5, the processor 110 adjusts the energy values of the plurality of frequency bands in the first signal spectrum and the extended signal spectrum by using equal loudness contours 50 of the psychoacoustic model, for example, thereby generating the second signal spectrum. Adjusting the energy values of various frequency bands by using the equal loudness contours may be expressed by equation (4):

$$\hat{b}_k^{\theta,\varphi}=\tilde{b}_k^{\theta,\varphi}\times \mathrm{ELC}_{high}(L,f) \tag{4}$$

Specifically, L is the loudness level, f is the frequency, $\mathrm{ELC}_{high}$(L, f) is equal loudness contours, k is 1~n (n is the number of frequency bands divided in the extended frequency domain), $\hat{b}_k^{\theta,\varphi}$ is the energy distribution after compensating for the extended frequency domain, and $\tilde{b}_k^{\theta,\varphi}$ is the energy of the extended frequency domain that is compensated according to the equal loudness contours. That is, the processor 110 multiplies the intensity level corresponding to the equal loudness contours by the energy value of the compensated extended energy distribution $b_1'$~$b_n'$ in the compensated extended signal spectrum to realize hearing compensation. Similarly, the processor 110 multiplies the intensity level of the frequency corresponding to the equal loudness contours by the energy values of the energy $a_1$~$a_m$ of various frequency bands of the first signal spectrum to realize hearing compensation.

Through the above method for obtaining Hi-Res audio transfer information, the processor 110 may convert the HRTF that initially corresponds to the first audio signal that records the head-related impulse response information but lacks high frequency portion into Hi-Res head-related transfer function (Hi-Res HRTF) having high frequency portion.

Figure 6:
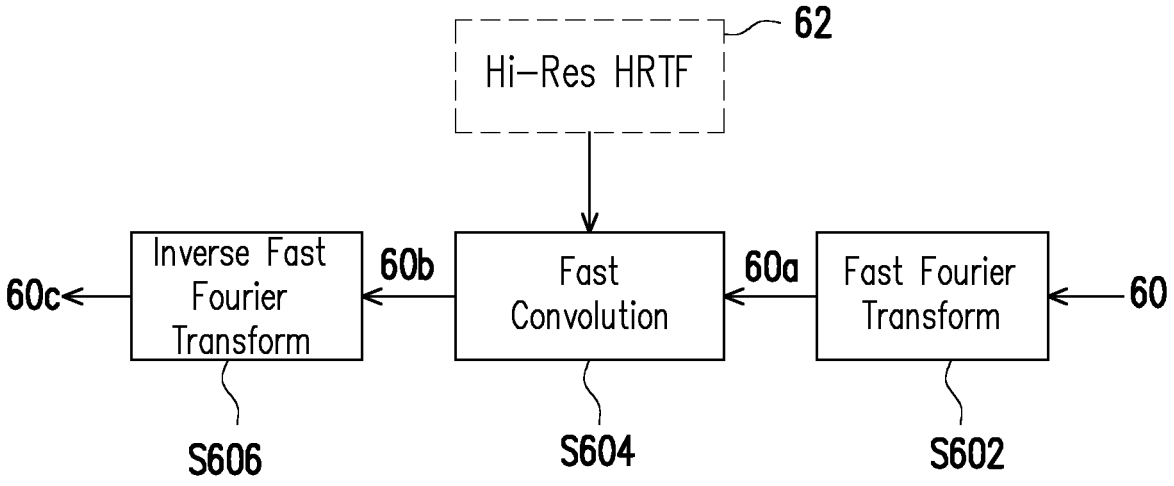
FIG. 6 is a flow chart of a method of using Hi-Res audio transfer information according to an embodiment of the disclosure.

FIG. 6 is a flow chart of a method of using Hi-Res audio transfer information according to an embodiment of the disclosure. Referring to FIG. 6, the embodiment is subsequent to step S210 in FIG. 2, that is, the processor 110 obtains the Hi-Res HRTF 62 via steps S202-S210. For the steps S202 to S210, reference to the related description may be derived from the foregoing embodiments, and details are not repeated herein. Assuming that the processor 110 captures an audio signal 60 of the Hi-Res audio data (the sampling frequency is, for example, 96 kHz or higher), the processor 110 first performs FFT on the audio signal 60 to generate a Hi-Res signal spectrum 60*a* (step S602). Next, the processor 110 performs a fast convolution algorithm on the Hi-Res signal spectrum 60*a* and the Hi-Res HRTF 62 in the frequency domain to generate a Hi-Res signal spectrum 60*b* (step S604). Finally, the processor 110 performs an IFFT on the Hi-Res signal spectrum 60*b* to generate a Hi-Res audio signal 60*c* (step S606). Specifically, through the Hi-Res HRTF provided by the disclosure, the audio signal 60 is converted into the Hi-Res audio signal 60*c* while retaining the frequency of the high-frequency band, so that the converted audio can maintain high resolution.

Figure 7:
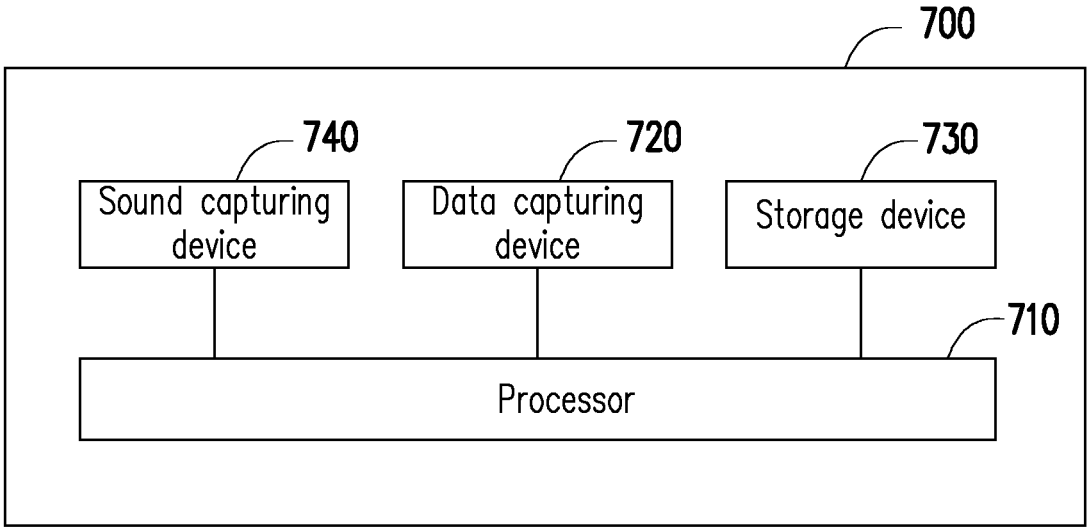
FIG. 7 is a block diagram of an electronic device according to an embodiment of the disclosure.

FIG. 7 is a block diagram of an electronic device according to an embodiment of the disclosure. Referring to FIG. 7, in another embodiment of the disclosure, an electronic device 700 further includes a sound capturing device 740. The sound capturing device 740 is disposed in the ear of the user, for example, in the form of a headset, and is coupled to the data capturing device 720. In the exemplary embodiment, the sound capturing device 740 is configured to capture an audio signal in which a head-related impulse response information is recorded with respect to a related impulse response of the sound source. In various embodiments, the sound capturing device 740 is, for example, a Dynamic Microphone, a Condenser Microphone, an Electret Condenser Microphone, a MEMS Microphone, or directional microphones having different sensitivities with respect to sounds from different angles, the disclosure is not limited to. The electronic device 700, the processor 710, the data capturing device 720, and the storage device 730 in this embodiment are similar to the electronic device 100, the processor 110, the data capturing device 120, and the storage device 130 in FIG. 1. Reference to the related description regarding the configuration of hardware may be derived from the foregoing embodiments, and details are not repeated herein.

For example, the user may place the sound capturing device 740 in the ears, respectively, and place the sound source in different directions of a space to play the audio, and the sound capturing device 740 captures the audio signal that is from the sound source and head-related affected. The processor 710 may use the method for obtaining Hi-Res audio transfer information in the disclosure to perform Hi-Res conversion on the low-resolution audio signal measured from sound sources at different angles in the space, thereby obtaining an audio signal that is head-related adjusted exclusively according to the individual user and has Hi-Res audio transfer information. Since the embodiment does not need to use a speaker capable of emitting high-frequency sound as a sound source, and does not need to use a recording device capable of receiving high-frequency sound, the user can obtain personalized H-Res audio transfer information at a low cost, applying the same to the processing of input signal to obtain a Hi-Res output result.

The disclosure further provides a non-transitory computer readable recording medium in which a computer program is recorded. The computer program performs various steps of the above method for obtaining Hi-Res audio transfer information. The computer program is composed of a plurality of code segments (such as creating an organization chart code segment, signing a form code segment, setting a code segment, and deploying a code segment). After these code segments are loaded into the electronic device and executed, the steps of the above method for obtaining Hi-Res audio transfer information are completed.

Based on the above, the method and the electronic device for obtaining Hi-Res audio transfer information provided by the disclosure are capable of converting an audio signal lacking a high-frequency band into a Hi-Res audio signal having a high-frequency band and directivity, and compensating for and adjusting the energy of a frequency band of the audio signal. Accordingly, the disclosure can obtain a Hi-Res audio signal and a Hi-Res head-related transfer function at a low cost. In addition, Hi-Res audio signals can be calculated with a lower amount of calculation, thereby avoiding the large amount of calculation caused by increased sampling frequency for obtaining audio with high-frequency bands.

Although the disclosure has been disclosed by the above embodiments, the embodiments are not intended to limit the disclosure. It will be apparent to those skilled in the art that various modifications and variations can be made to the structure of the disclosure without departing from the scope or spirit of the disclosure. Therefore, the protecting range of the disclosure falls in the appended claims.

What is claimed is:

1. A method for obtaining Hi-Res audio transfer information, adapted for an electronic device having a processor, the method comprising the steps of:

capturing a first audio signal;

converting the first audio signal from a time domain into a frequency domain to generate a first signal spectrum;

performing a regression analysis on an energy distribution of the first signal spectrum to predict an extended energy distribution in the frequency domain according to the first signal spectrum;

compensating for the extended energy distribution by using a head-related parameter to generate an extended signal spectrum;

combining the first signal spectrum with the extended signal spectrum to generate a second signal spectrum; and converting the second signal spectrum from the frequency domain into the time domain to generate a second audio signal having Hi-Res audio transfer information.

2. The method for obtaining Hi-Res audio transfer information according to claim 1, wherein the first audio signal records a head-related impulse response information.

3. The method for obtaining Hi-Res audio transfer information according to claim 1, wherein the step of combining the first signal spectrum with the extended signal spectrum to generate the second signal spectrum comprises:

adjusting energy values of a plurality of frequency bands in the first signal spectrum and the extended signal spectrum by using equal loudness contours of a psychoacoustic model to generate a second signal spectrum.

4. The method for obtaining Hi-Res audio transfer information according to claim 1, wherein the first audio signal is obtained by capturing a related impulse response of a sound source by using a sound capturing device disposed on ears.

5. The method for obtaining Hi-Res audio transfer information according to claim 1, wherein the step of performing the regression analysis on the energy distribution of the first signal spectrum to predict the extended energy distribution in the frequency domain according to the first signal spectrum comprises:

dividing the first signal spectrum into a plurality of frequency bands; and performing the regression analysis to predict the extended energy distribution of the first signal spectrum in the frequency domain above the highest frequency according to an energy relationship between the frequency bands.

6. The method for obtaining Hi-Res audio transfer information according to claim 1, wherein the step of compensating for the extended energy distribution by using the head-related parameter to generate the extended signal spectrum comprises:

reconstructing the extended signal spectrum including information of the extended energy distribution and subjected to head-related compensation in the frequency domain.

7. The method for obtaining Hi-Res audio transfer information according to claim 6, wherein the step of compensating for the extended energy distribution by using the head-related parameter to generate the extended signal spectrum comprises:

determining a weight grid according to the head-related parameter, wherein the weight grid is divided into a plurality of weight grid areas corresponding to a plurality of directions of the electronic device, and records energy weights of a sound source in different weight grid areas; and selecting an energy weight of the weight grid area corresponding to a direction of the first audio signal to compensate for the extended energy distribution in the frequency domain to reconstruct the extended signal spectrum including the information of the extended energy distribution and subjected to head-related compensation in the frequency domain.

8. The method for obtaining Hi-Res audio transfer information according to claim 7, wherein the head-related parameter comprises a shape, a size, a structure and/or a density of a head, an ear, a nasal cavity, an oral cavity and a torso, and the weight grid is adjusted according to the head-related parameter.

9. The method for obtaining Hi-Res audio transfer information according to claim 1, further comprising:

receiving a third audio signal of a Hi-Res audio data, and converting the third audio signal into a third signal spectrum in the frequency domain;

performing a fast convolution operation on the third signal spectrum and the second signal spectrum to obtain a fourth signal spectrum; and converting the fourth signal spectrum into a fourth audio signal of a Hi-Res audio subjected to head-related compensation in the time domain.

10. An electronic device, comprising:

a data capturing device, capturing an audio signal;

a storage device, storing one or more instructions; and a processor, coupled to the data capturing device and the storage device, the processor configured to execute the instructions to:

control the data capturing device to capture a first audio signal;

convert the first audio signal from a time domain into a frequency domain to generate a first signal spectrum;

perform a regression analysis on an energy distribution of the first signal spectrum to predict an extended energy distribution in the frequency domain according to the first signal spectrum;

compensate for the extended energy distribution by using a head-related parameter to generate an extended signal spectrum; and combine the first signal spectrum with the extended signal spectrum to generate a second signal spectrum, and convert the second signal spectrum from the frequency domain into the time domain to generate a second audio signal having Hi-Res audio transfer information.

11. The electronic device according to claim 10, wherein the first audio signal records a head-related impulse response information.

12. The electronic device according to claim 10, wherein in the operation of combining the first signal spectrum with the extended signal spectrum to generate the second signal spectrum, the processor is configured to utilize equal loudness contours of a psychoacoustic model to adjust energy values of a plurality of frequency bands in the first signal spectrum and the extended signal spectrum to generate the second signal spectrum.

13. The electronic device according to claim 10, wherein the electronic device further comprises:

a sound capturing device, disposed on an ear and coupled to the data capturing device, wherein the first audio signal is obtained by using the sound capturing device to capture a related impulse response of a sound source.

14. The electronic device according to claim 10, wherein in the operation of performing the regression analysis on the energy distribution of the first signal spectrum to predict the extended energy distribution in the frequency domain according to the first signal spectrum, the processor is configured to:

divide the first signal spectrum into a plurality of frequency bands; and perform the regression analysis to predict the extended energy distribution of the first signal spectrum in the frequency domain above the highest frequency according to an energy relationship between the frequency bands.

15. The electronic device according to claim 10, wherein in the operation of compensating for the extended energy distribution by using the head-related parameter to generate the extended signal spectrum, the processor is configured to:

reconstruct the extended signal spectrum including information of the extended energy distribution and subjected to head-related compensation in the frequency domain.

16. The electronic device according to claim 15, wherein in the operation of compensating for the extended energy distribution by using the head-related parameter to generate the extended signal spectrum, the processor is configured to:

determine a weight grid according to the head-related parameter, wherein the weight grid is divided into a plurality of weight grid areas corresponding to a plurality of directions of the electronic device, and records energy weights of a sound source in different weight grid areas; and select an energy weight of the weight grid area corresponding to a direction of the first audio signal to compensate for the extended energy distribution in the frequency domain to reconstruct the extended signal spectrum including the information of the extended energy distribution and subjected to head-related compensation in the frequency domain.

17. The electronic device according to claim 16, wherein the processor is configured to adjust the weight grid according to the head-related parameter.

18. The electronic device according to claim 17, wherein the head-related parameter comprises a shape, a size, a structure and/or a density of a head, an ear, a nasal cavity, an oral cavity and a torso.

19. The electronic device according to claim 10, wherein the processor is further configured to:

receive a third audio signal of a Hi-Res audio data, and convert the third audio signal into a third signal spectrum in the frequency domain;

perform a fast convolution operation on the third signal spectrum and the second signal spectrum to obtain a fourth signal spectrum; and convert the fourth signal spectrum into a fourth audio signal of a Hi-Res audio subjected to head-related compensation in the time domain.

20. A non-transitory computer readable recording medium, recording a program, and loaded via an electronic device to perform the following steps:

capturing a first audio signal;

converting the first audio signal from a time domain into a frequency domain to generate a first signal spectrum;

performing a regression analysis on an energy distribution of the first signal spectrum to predict an extended energy distribution in the frequency domain according to the first signal spectrum;

compensating for the extended energy distribution by using a head-related parameter to generate an extended signal spectrum; and combining the first signal spectrum with the extended signal spectrum to generate a second signal spectrum, and converting the second signal spectrum from the frequency domain into the time domain to generate a second audio signal having Hi-Res audio transfer information.

* * * * *